US006490341B1

(12) United States Patent
Ochiai et al.

(10) Patent No.: US 6,490,341 B1
(45) Date of Patent: Dec. 3, 2002

(54) X-RAY TUBE, X-RAY GENERATOR, AND INSPECTION SYSTEM

(75) Inventors: Yutaka Ochiai, Hamamatsu (JP); Tutomu Inazuru, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 09/633,160

(22) Filed: Aug. 4, 2000

Related U.S. Application Data

(63) Continuation-in-part of application No. PCT/JP99/00509, filed on Feb. 5, 1999.

(30) Foreign Application Priority Data

Feb. 6, 1998 (JP) ..... 10-025878

(51) Int. Cl.[7] ..... H01J 35/18
(52) U.S. Cl. ..... 378/140; 378/121
(58) Field of Search ..... 378/140, 121, 378/124

(56) References Cited

U.S. PATENT DOCUMENTS

| | | | | | |
|---|---|---|---|---|---|
| 1,708,494 | A | * | 4/1929 | Bucky | 378/140 |
| 2,019,612 | A | * | 11/1935 | Laghans | 378/140 |
| 2,919,362 | A | * | 12/1959 | Atlee | 378/140 |
| 4,159,437 | A | | 6/1979 | Sahores | 313/59 |
| 5,515,412 | A | * | 5/1996 | Shida | 378/121 |
| 5,598,453 | A | * | 1/1997 | Baba et al. | 378/146 |
| 5,987,096 | A | * | 11/1999 | Van Der Borst et al. | 378/121 |

FOREIGN PATENT DOCUMENTS

| | | |
|---|---|---|
| CH | 677 302 | 4/1991 |
| EP | 0 553 913 | 8/1993 |
| FR | 2 355 428 | 1/1978 |
| JP | 49-139914 | 12/1974 |
| JP | 2-138855 | 5/1990 |
| JP | 4-35343 | 3/1992 |
| JP | 6-18450 | 1/1994 |
| JP | 6-94650 | 4/1994 |
| JP | 6-315152 | 11/1994 |
| JP | 7-29532 | 1/1995 |
| JP | 7-230892 | 8/1995 |
| JP | 7-296751 | 11/1995 |

* cited by examiner

*Primary Examiner*—Robert H. Kim
*Assistant Examiner*—Irakli Kiknadze
(74) *Attorney, Agent, or Firm*—Morgan, Lewis & Bockius LLP

(57) ABSTRACT

An x-ray emitting window is formed at a front end face, and a taper surface tilted with respect to the x-ray emitting direction is formed near the emitting window, whereby an object to be inspected can be prevented from abutting against the front end face even if the object is pivoted about an axis intersecting the emitting direction while the object is disposed closer to the x-ray emitting window. As a consequence, while the object is disposed closer to the x-ray emitting position, the orientation of the object can be changed. Therefore, when inspecting the internal structure of the object and the like by irradiating the object with x-rays and detecting the x-rays transmitted through the object, not only a magnified penetration image of the object with a high magnification rate is obtained, but also the internal structure of the object and the like can be verified in detail by changing the orientation of the object.

1 Claim, 11 Drawing Sheets

X-RAY TUBE, X-RAY GENERATOR, AND INSPECTION SYSTEM

RELATED APPLICATION

The present application is a continuation-in-part application of PCT application No PCT/JP99/00509 filed on Feb. 5, 1999, designating the U.S.A. and now pending.

BACKGROUND OF THE INVENTION

1. Field of the invention

The present invention relates to an x-ray tube for generating x-rays, an x-ray generator, and an inspection system for an object to be inspected using them.

2. Related Background Art

Known as a conventional x-ray tube is one incorporating therein an electron gun for emitting electrons and a target for generating x-rays in response to the electrons as described in Japanese Patent Application Laid-Open No. HEI 7-296751. On the other hand, known as a conventional x-ray generator is one incorporating therein an x-ray tube, a driving circuit for the x-ray tube, and the like as described in Japanese Patent Application Laid-Open No. HEI 7-29532.

Such x-ray tube and x-ray generator are mainly used for nondestructive/noncontact observation of internal structures of objects and the like as described in Japanese Patent Application Laid-Open No. HEI 6-315152. For example, an object to be inspected is irradiated with x-rays emitted from the x-ray tube and x-ray generator, and the x-rays transmitted through the object are detected by an x-ray/fluorescence multiplier (an image intensifier tube: I.I. tube) or the like. Then, the resulting magnified penetration image of the object is observed, whereby the nondestructive/noncontact observation of internal structure of object becomes possible.

In general, as described in Japanese Patent Application Laid-Open Nos. HEI 6-94650 and HEI 6-18450, such an inspection of the object to be inspected employs a technique in which the object is rotated about an axis orthogonal to the direction in which the x-rays are emitted, so as to change the orientation of the object, thereby accurately specifying a defective site.

On the other hand, the magnification rate of the penetration image is determined by the ratio between the distance (A) from the x-ray generating position (the focal position of the x-ray tube) within the x-ray tube apparatus to the position of the object and the distance (B) from the position of the object to the x-ray entrance surface of the I.I. tube. That is, the magnification rate M is expressed by $$M=(A+B)/A. \quad (1)$$

Normally, A<<B, and therefore the expression (1) can be represented by $$M=B/A. \quad (2)$$

Namely, for yielding a greater magnification rate, decreasing A or increasing B may be considered. Increasing B, however, not only enhances the overall size of the x-ray inspection apparatus, but also remarkably increases its weight by requiring a greater amount of lead shield for keeping the x-rays from leaking outside, and so forth.

Therefore, it is desirable that Abe as small as possible. In the case using a technique in which the orientation of the object to be inspected is changed as mentioned above, however, a sample holder for mounting the object or the like may come into contact with the exit surface of the x-ray tube if A is made smaller. Consequently, there is a certain limit to increasing the magnification rate of penetration image. Hence, it has been difficult to accurately inspect the state of an object to be inspected while observing a penetration image thereof with a high magnification rate.

SUMMARY OF THE INVENTION

For overcoming problems such as those mentioned above, it is an object of the present invention to provide an x-ray tube, x-ray generator, and inspection system which can emit x-rays while objects to be inspected are disposed closer thereto.

The present invention provides an x-ray tube having a front end face with an x-ray emitting window, and a taper surface disposed near the emitting window of the front end face and tilted with respect to an x-ray emitting direction. Also, the present invention provides an x-ray tube in which two taper surfaces each mentioned above are symmetrically formed on both sides about the emitting window. Further, the present invention provides an x-ray tube in which the two taper surfaces are tilted by the same angle with respect to the x-ray emitting direction. Also,the present invention provides an x-ray tube employed in an inspection system which inspects a state of an object to be inspected by emitting an x-ray toward the object and detecting the x-ray transmitted through the object, the inspection system being capable of adjusting an orientation of the object about an axis intersecting an x-ray emitting direction, wherein the x-ray tube has an x-ray emitting window disposed at a front end face thereof facing the object, and a taper surface formed near the emitting window of the front end face and tilted with respect to an x-ray emitting direction while being parallel to the axis.

When these aspects of the invention are employed in an inspection system which inspects an internal structure of an object to be inspected and the like by irradiating the object with an x-ray and detecting the x-ray transmitted through the object, the taper surface formed therein can prevent the object from abutting against the front end face even if the object is pivoted about the axis intersecting the emitting direction while the object is disposed close to the x-ray emitting window. Therefore, while the object to be inspected is disposed close to the x-ray emitting position, the orientation of the object can be changed. As a consequence, not only a magnified penetration image of the object with a high magnification rate is obtained, but also the internal structure of the object and the like can be verified in detail while the orientation of the object is changed.

On the other hand, the present invention provides an x-ray generator comprising x-ray emitting means for emitting an x-ray, wherein the x-ray emitting means is any of the above-mentioned x-ray tubes. Also, the present invention provides an x-ray generator comprising x-ray emitting means for emitting an x-ray, the x-ray generator comprising a housing for accommodating a component, wherein a surface of the housing provided with an emitting window of the x-ray emitting means is formed with a taper surface tilted with respect to an x-ray emitting direction. Further, the present invention provides an x-ray generator in which the emitting window is disposed in a surface of the housing at a position lopsided to one side, and the taper surface is formed in the surface on the other side. Also, the present invention provides an x-ray generator in which two taper surfaces each mentioned above are symmetrically formed on both sides about the emitting window. Further, the present invention provides an x-ray generator in which the two taper surfaces are tilted with respect to the x-ray emitting direction by the same angle.

When these aspects of the invention are employed in an inspection system which inspects an internal structure of an object to be inspected and the like by irradiating the object with an x-ray and detecting the x-ray transmitted through the object, the taper surface formed therein can prevent the object from abutting against the front end face even if the object is pivoted about the axis intersecting the emitting direction while the object is disposed close to the x-ray emitting window. Therefore, while the object to be inspected is disposed close to the x-ray emitting position, the orientation of the object can be changed. As a consequence, not only a magnified penetration image of the object with a high magnification rate is obtained, but also the internal structure of the object and the like can be verified in detail while the orientation of the object is changed.

Also, the present invention provides an inspection system for inspecting a state of an object to be inspected by irradiating the object with an x-ray and detecting the x-ray transmitted through the object; the inspection system comprising any of the above-mentioned x-ray generators for emitting an x-ray; pivoting means for pivoting the object about an axis intersecting an x-ray emitting direction; and x-ray detecting means, disposed behind the object in the x-ray emitting direction, for detecting the x-ray transmitted through the object.

According to this aspect of the. invention, the taper surface formed therein can prevent the object from abutting against the front end face even if the object is pivoted about the axis intersecting the emitting direction while the object is disposed close to the x-ray emitting window. Therefore, while the object to be inspected is disposed close to the x-ray emitting position, the orientation of the object can be changed. As a consequence, not only a magnified penetration image of the object with a high magnification rate is obtained, but also the internal structure of the object and the like can be verified in detail while the orientation of the object is changed.

DESCRIPTION OF THE PREFERRED EMBODIMENTS

Figure 1:
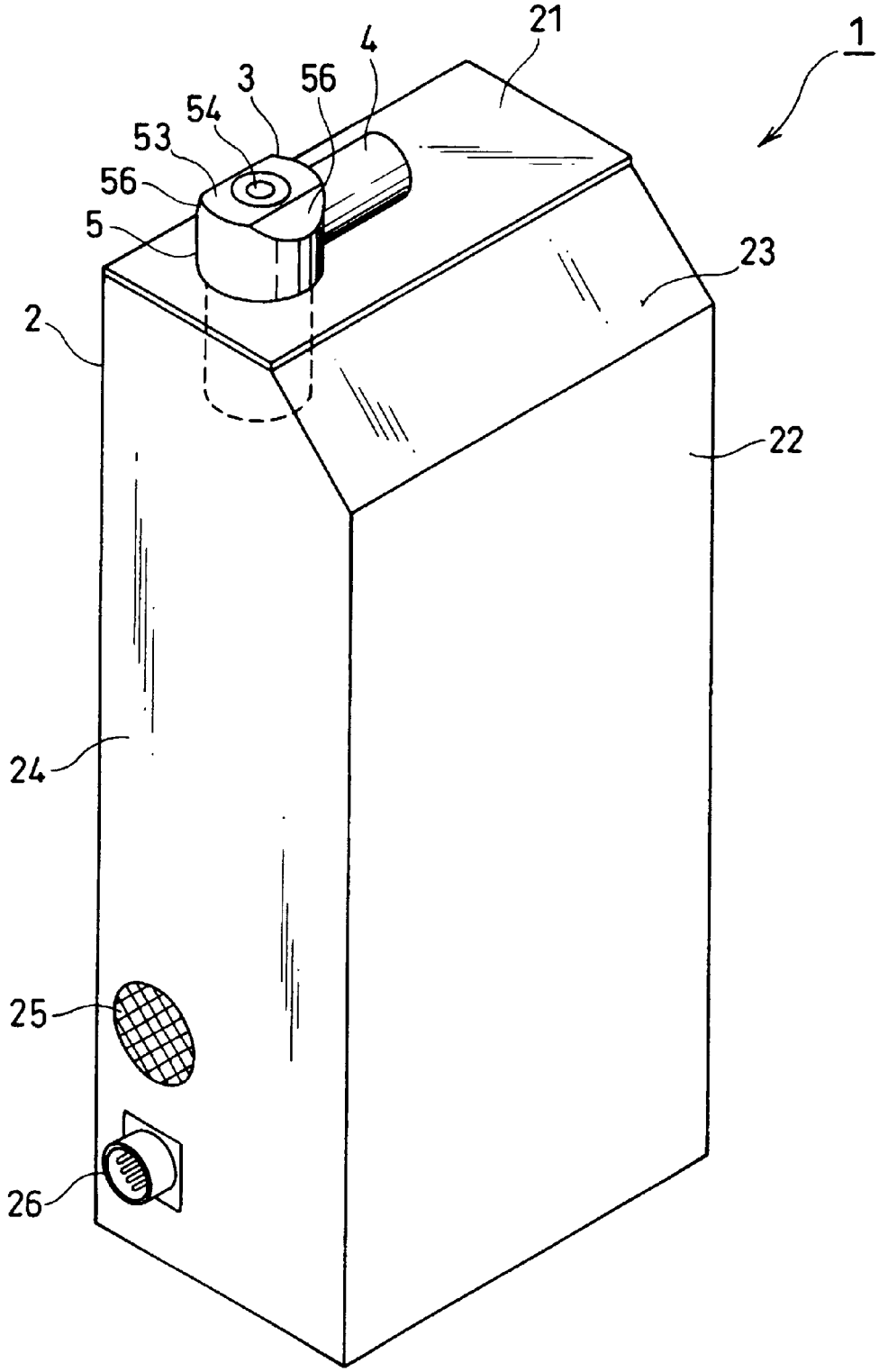
FIG. 1 is an explanatory view of an x-ray tube and x-ray generator in accordance with a first embodiment.

In the following, with reference to the accompanying drawings, embodiments of the present invention will be explained. Among the drawings, constituents identical to each other will be referred to with numerals identical to each other without repeating their overlapping descriptions. Also, ratios of dimensions in the drawings do not always coincide with those explained.

First Embodiment

FIG. 1 shows the x-ray generator and x-ray tube in accordance with this embodiment. As shown in FIG. 1, the x-ray generator 1 is an apparatus for emitting x-rays, and comprises a housing 2 for accommodating components such as a driving circuit. The housing 2 is substantially shaped like a vertically elongated rectangular parallelepiped, with its top face 21 equipped with an x-ray tube 3 for emitting x-rays. A ridge portion of the housing 2 between the top face 21 and a side face 22 is chamfered so as to form a taper surface 23. The taper surface 23 is a surface tilted with respect to the x-ray emitting direction (the vertical direction in FIG. 1) and is formed in a direction neither parallel nor perpendicular to the x-ray emitting direction.

Also, the taper surface 23 is formed only at the ridge portion between the top face 21 of the housing 2 and one side face 22 thereof. The x-ray tube 3 is formed at a position lopsided to one side from the center of the housing 2. For example, the x-ray tube 3 is formed at a position lopsided to the side not formed with the taper surface 23. The x-ray tube 3 generates x-rays, and comprises an electron gun portion 4 and an x-ray generating portion 5.

The lower part of the front face 24 of the housing 2 is provided with a ventilation port 25 and a connector 26. The ventilation port 25 is used for communicating the air between the inside and outside of the housing 2, and a cooling fan (not depicted) is disposed inside the ventilation port 25. The connector 26 is used for wiring connection to an x-ray controller for controlling the driving of the x-ray generator 1 or the like.

Figure 2:
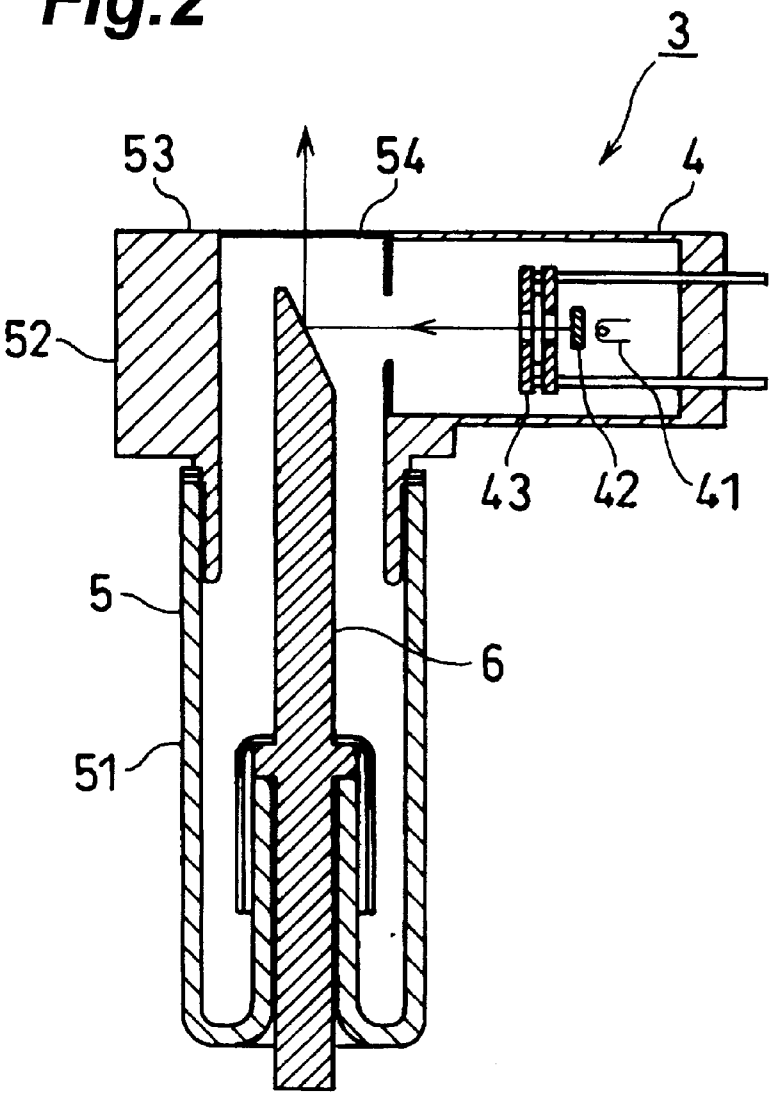
FIG. 2 is an explanatory view of the x-ray tube in accordance with the first embodiment.
Figure 3:
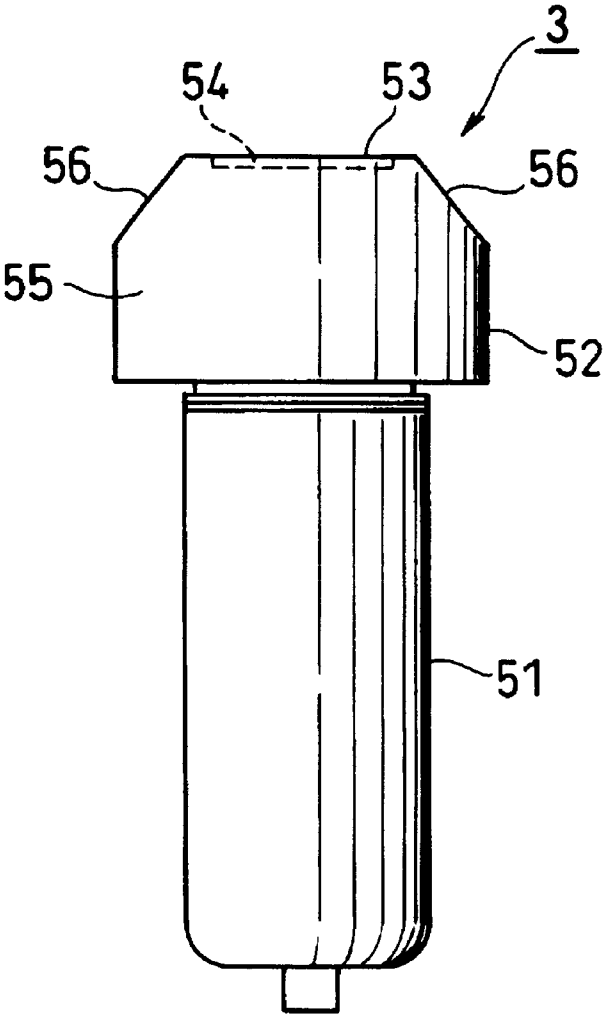
FIG. 3 is an explanatory view of the x-ray tube in accordance with the first embodiment.

FIG. 2 shows a sectional view of the x-ray tube in accordance with this embodiment, whereas FIG. 3 shows a front view of the x-ray tube.

As shown in FIG. 3, the x-ray generating portion 5 of the x-ray tube 3 is used for generating x-rays in response to electrons from the electron gun portion 4, and is constituted by a body part 51 and a head part 52. The head part 52 has a columnar form with its axial direction oriented vertically, and its top face 53 has an x-ray emitting window 54 for emitting x-rays. Also, ridge portions between the top face 53 and side face 55 of the head part 52 are chamfered, so as to form taper surfaces 56.

Each taper surface 56 is a surface tilted with respect to the x-ray emitting direction (the vertical direction in FIGS. 2 and 3), and is formed in a direction neither parallel nor perpendicular to the x-ray emitting direction. Two taper surfaces 56 are symmetrically formed about the x-ray emitting window 54, while forming the same angle with respect to the x-ray emitting direction.

As shown in FIG. 2, the electron gun portion 4 is connected to a side portion of the head part 52 of the x-ray generating portion 5. The electron gun portion 4 generates electrons and emit them toward the x-ray.,generating portion 5; whereas a heater 41 for generating heat in response to an electric power supplied thereto from the outside, a cathode 42 for emitting electrons when heated by the heater 41, and a focus grid electrode 43 for converging the electrons emitted from the cathode 42 are disposed inside thereof. The respective inner spaces of the electron gun portion 4 and x-ray generating portion 5 communicate with each other and are sealed off from the outside of the x-ray tube 3. Also, the inner spaces of the electron gun portion 4 and x-ray generating portion 5 are held in a substantially vacuum state.

A target 6 is installed within the x-ray generating portion 5. The target 6 receives electrons from the electron gun portion 4 at a front end face thereof and generates x-rays, and is disposed as being oriented in the axial direction of the head part 52 and body part 51 of the x-ray generating portion 5.

Figure 4:
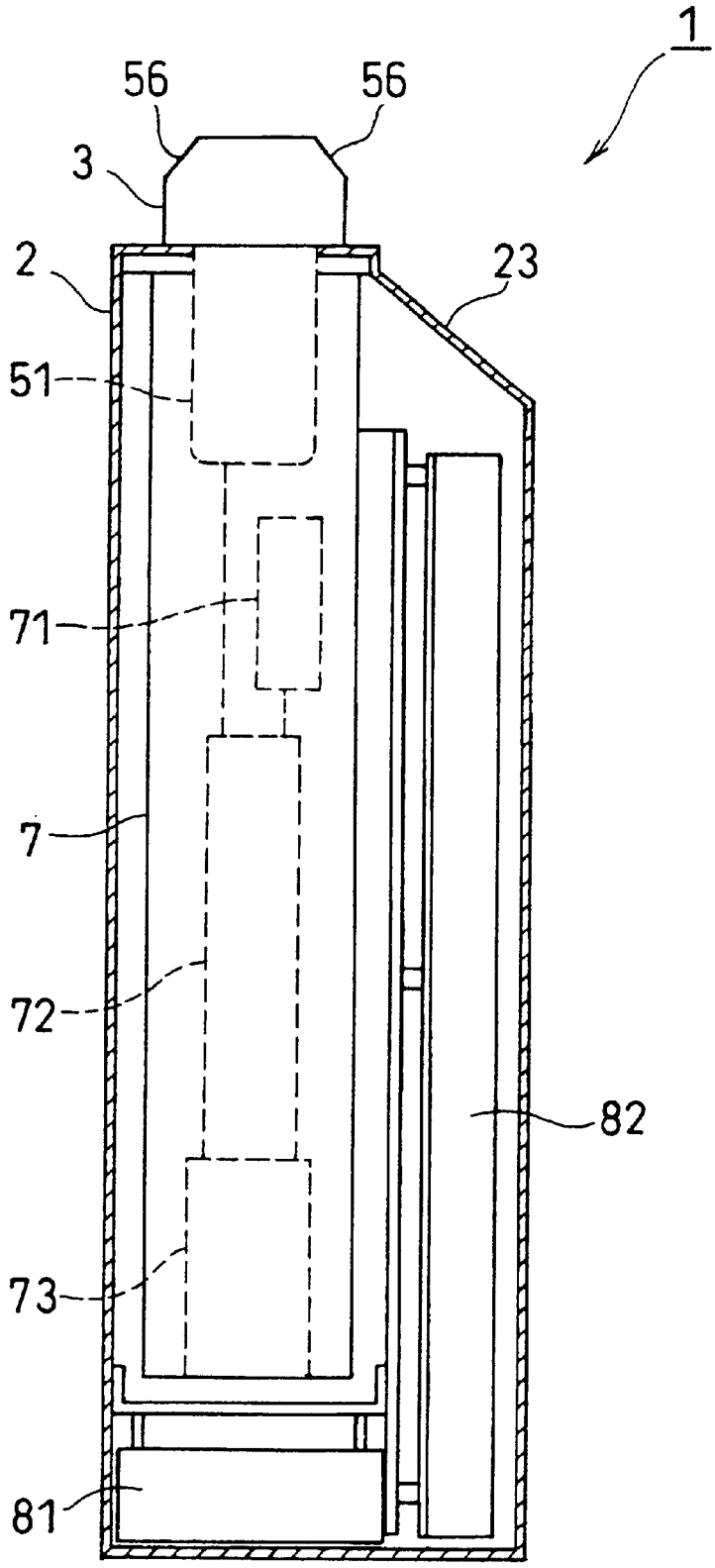
FIG. 4 is an explanatory view of the x-ray generator in accordance with the first embodiment.

FIG. 4 shows a sectional view of the x-ray generator as seen from the front side.

As shown in FIG. 4, a high-voltage block portion 7 is disposed within the housing 2 of the x-ray generator 1. The high-voltage block portion 7 accommodates therein components to which a high voltage is applied. Namely, the body part 51 of the x-ray tube 3, a bleeder resistance 71, a Cockcroft circuit 72, a step-up transformer 73, and the like are incorporated in the high-voltage block portion 7. Also, driving circuits 81, 82 are installed within the housing 2. The driving circuits 81, 82 are constituted by a target voltage circuit, a cathode voltage circuit, a grid voltage circuit, a heater voltage circuit, and the like.

A method of using the x-ray tube and x-ray generator will now be explained.

Figure 5:
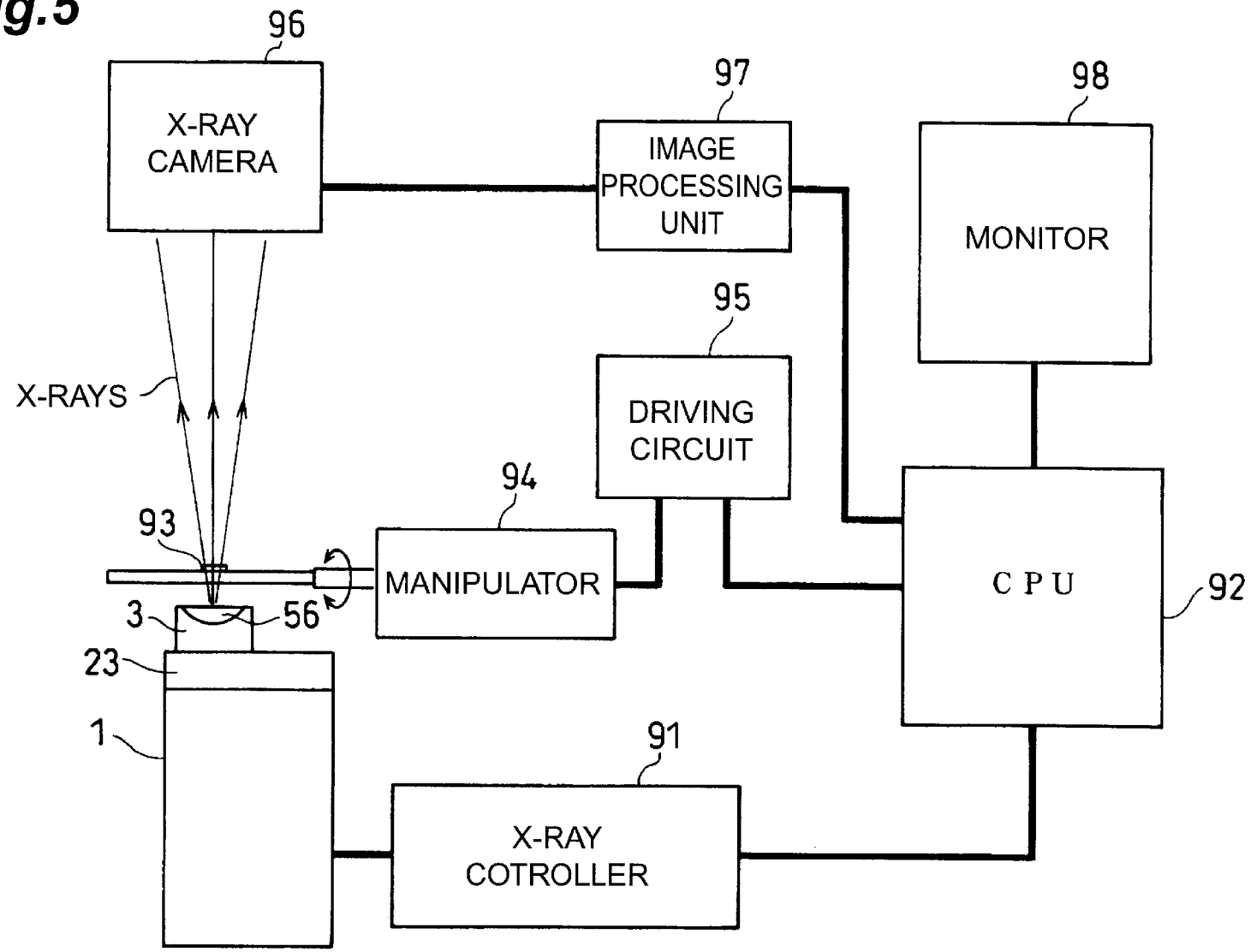
FIG. 5 is an explanatory view of an inspection system using the x-ray generator and x-ray tube.

FIG. 5 shows the configuration of an inspection system using the x-ray tube and x-ray generator. As shown in FIG. 5, an x-ray controller 91 is connected to the x-ray generator 1. The x-ray controller 91 controls actions of the x-ray generator 1. The x-ray controller 91 is connected to a CPU 92. The CPU 92 controls the whole inspection system.

A sample 93 to be inspected is disposed in the x-ray emitting direction of the x-ray generator 1. The sample 93 includes not only electronic devices such as IC and aluminum die-cast products, but also various products and components made of metals, rubbers, plastics, ceramics, and the like. The sample 93 is adapted to change its orientation by rotating about an axis substantially orthogonal to the x-ray emitting direction upon actuation of a manipulator 94. The manipulator 94 has a rotary shaft which is substantially orthogonal to the x-ray emitting direction, and drives the rotary shaft by way of a driving circuit 95 upon a command from the CPU 92.

Also, the manipulator 94 has such a structure that it can move the sample 93 in the x-ray emitting direction. Upon this movement, the sample 93 moves toward or away from the x-ray emitting position. Therefore, the magnification rate of the magnified penetration image of the sample 93 obtained by the inspection system can be changed arbitrarily.

If the sample 93 to be inspected is planar, then it can be directly attached to the rotary shaft of the manipulator 94. If the sample 93 is not planar or is minute, then it may be indirectly attached to the rotary shaft of the manipulator 94 by way of a planar holder or the like.

An x-ray camera 96 is installed behind the sample 93 in the x-ray emitting direction. The x-ray camera 96 incorporates therein an image intensifier tube or the like and detects x-rays. An image processing unit 97 is connected to the x-ray camera 96, and a magnified penetration image of the sample 93 is formed by the image processing unit 97. Also, the image processing unit 97 is connected to the CPU 92 and transmits data of the magnified penetration image of the sample 93 to the CPU 92. On the other hand, a monitor 98 is connected to the CPU 92. According to a signal transmitted from the CPU 92, the monitor 98 displays the magnified penetration image of the sample 93.

When the sample 93 is set in front of the x-ray emitting position while x-rays are emitted from the x-ray generator 1 in such an inspection system, the x-rays irradiate the sample 93 and are transmitted through the sample 93, so as to enter the x-ray camera 96. The x-rays are detected by the x-ray camera 96 and are converted into an electric signal. The resulting signal is fed into the image processing unit 97, and is arithmetically operated so as -to yield data for the magnified penetration image of the sample 93. The data for the magnified penetration image are transmitted to the monitor 98 by way of the CPU 92, and the magnified penetration image of the sample 93 is displayed on the monitor 98 according to the data for the magnified penetration image.

Therefore, the internal structure of the sample 93 and the like can be verified by seeing the magnified penetration image of the sample 93.

On the other hand, the internal structure of the sample 93 and the like can be grasped more accurately if the orientation of the sample 93 is changed with respect to the x-ray irradiating direction. Namely, if the rotary shaft of the manipulator 4 is appropriately pivoted so as to change the orientation of the sample 93, then magnified penetration. images of the sample 93 seen from different directions can be displayed on the monitor 98. Therefore, whether hair cracks, bubbles, and the like exist or not within the sample 93 can be determined accurately.

Figure 6:
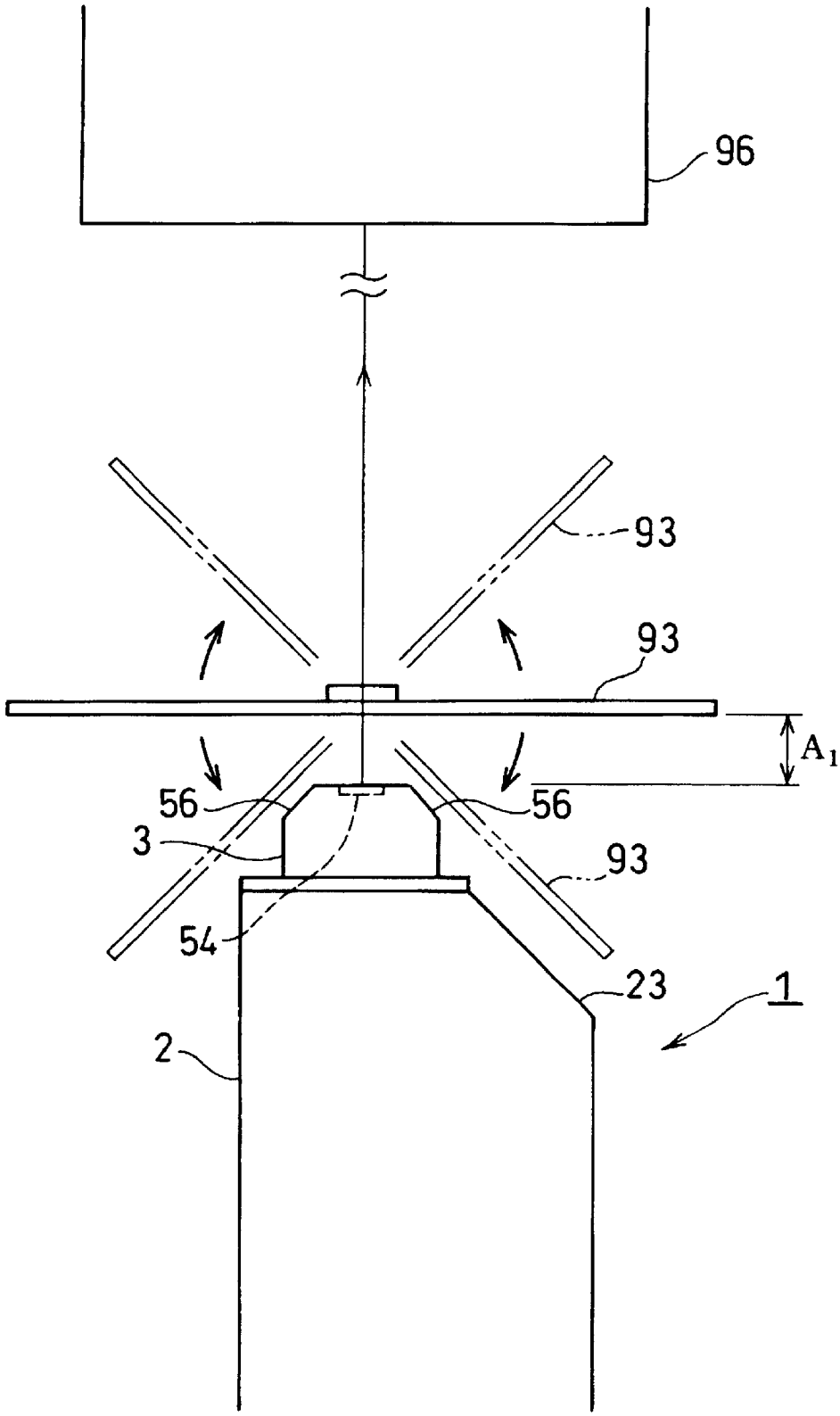
FIG. 6 is an explanatory view of a method of using the x-ray generator and x-ray tube.

Here, as shown in FIG. 6, the x-ray generator 1 is formed with the taper surface 23 tilted with respect to the x-ray emitting direction, the x-ray tube 3 is disposed at a position lopsided from the center of the housing 2, and the x-ray tube 3 is formed with the taper surfaces 56 tilted with respect to the x-ray emitting direction.

Therefore, while the sample 93 is disposed closer to the x-ray emitting window 54, the orientation of the sample 93 can fully be changed. Hence, while a magnified penetration image of the sample 93 with a high magnification rate is obtained, the internal structure and the like of the sample 93 can be verified in detail by changing the orientation of the sample 93.

Meanwhile, in contrast to such x-ray generator 1 and x-ray tube 3 in accordance with this embodiment, no magnified penetration image of the sample 93 with a high magnification rate can be obtained while changing the orientation of the sample 93 when the sample 93 is inspected by use of an x-ray generator not formed with the taper surface 23 and an x-ray tube not formed with the taper surfaces 56.

Figure 7:
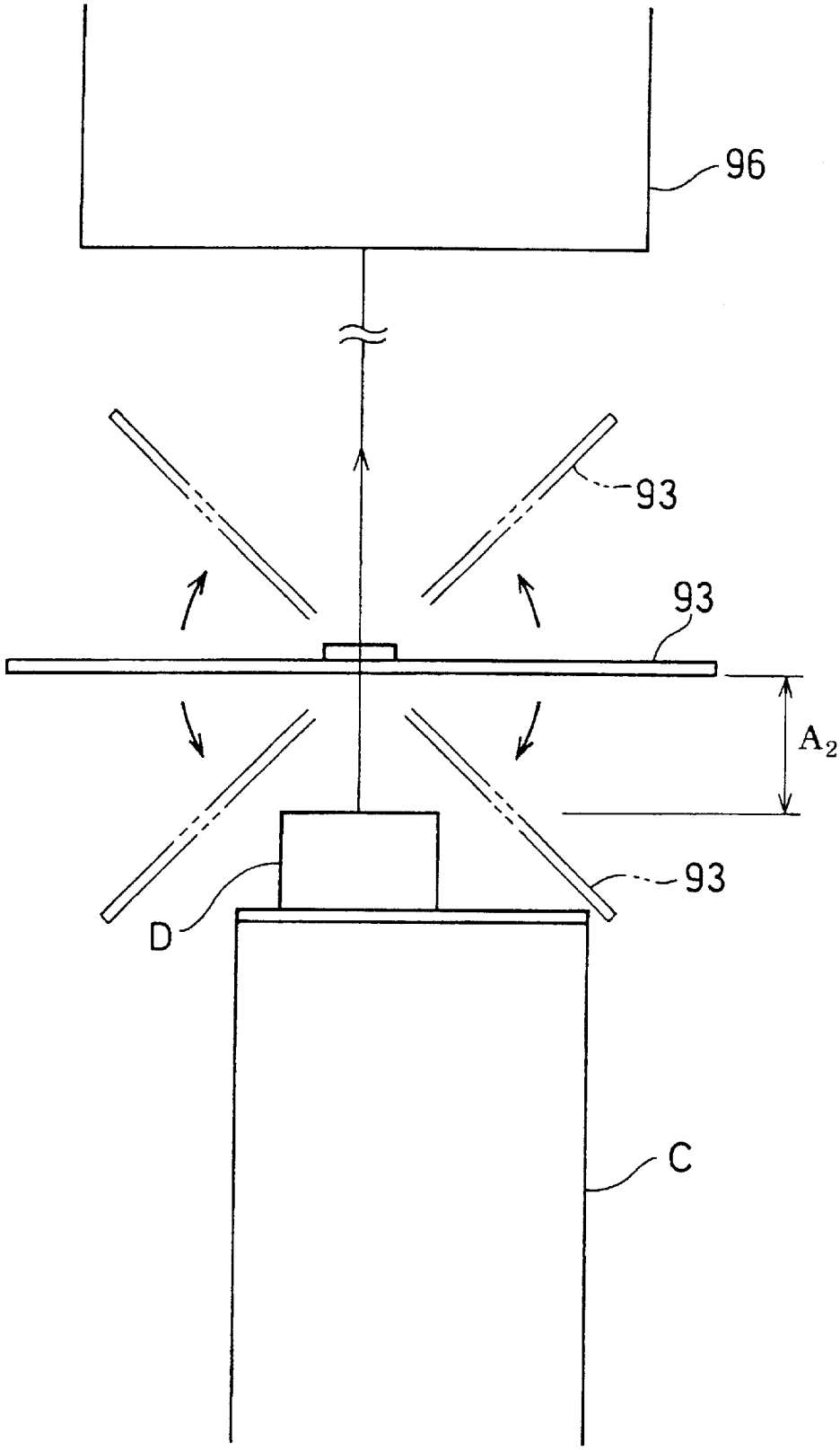
FIG. 7 is an explanatory view of background art.

For example, as shown in FIG. 7, when the sample 93 is being inspected by use of an x-ray generator C not formed with the taper surface 23 and an x-ray tube D not formed with the taper surfaces 56, the sample 93 may come into contact with ridge portions of the x-ray generator C or ridge portions of the x-ray generator D if the orientation of the sample 93 is to be changed while the sample 93 is caused to approach the x-ray emitting position in order to raise the magnification rate of the magnified penetration image of the sample 93.

For this reason, the sample 93 must be separated from the x-ray emitting position by a predetermined distance A2 or more in order to change the orientation of the sample 93. This distance A2 directly influences the magnification rate of the magnified penetration image as indicated by the above-mentioned expression (2), such that the magnification rate increases as the distance A2 is shorter. Also, the distance A2 is longer than the distance A1 in the case where the x-ray generator 1 and x-ray tube 3 in accordance with this embodiment are used (see FIG. 6). As a consequence, in the x-ray generator C not formed with the taper surface 23 and the x-ray tube D not formed with the taper surfaces 56 as such, a magnified penetration image with a high magnification rate cannot be obtained, and the internal structure of the sample 93 and the like cannot be verified in detail.

As in the foregoing, the x-ray generator 1 and x-ray tube 3 in accordance with this embodiment and the inspection system using them can change the orientation of the sample 93 while disposing it closer to the x-ray emitting position. As a consequence, while a magnified penetration image of the sample 93 with a high magnification rate is obtained, the internal structure of the sample 93 and the like can be verified in detail by changing the orientation of the sample 93.

Second Embodiment

The x-ray tubes, x-ray generator, and the like in accordance with a second embodiment will now be explained.

Figure 8:
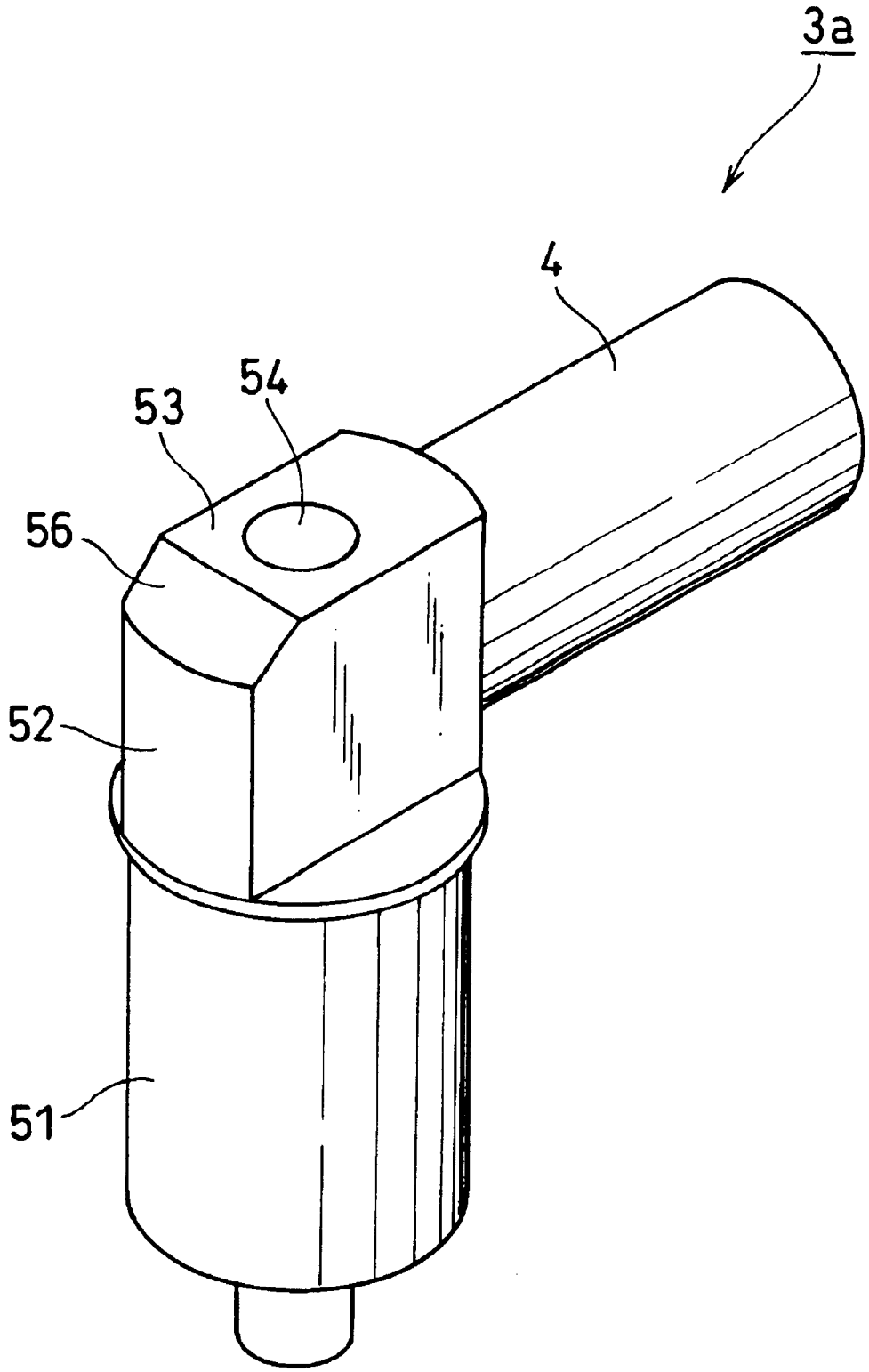
FIG. 8 is an explanatory view of an x-ray tube in accordance with a second embodiment.

FIG. 8 shows an x-ray tube 3*a* in accordance with this embodiment. In the x-ray tube 3*a*, as shown in FIG. 8, both side portions of the head part 52 are vertically shaved off, and a taper surface 56 is formed at the upper portion of the head part 52 on the front side.

Figure 9:
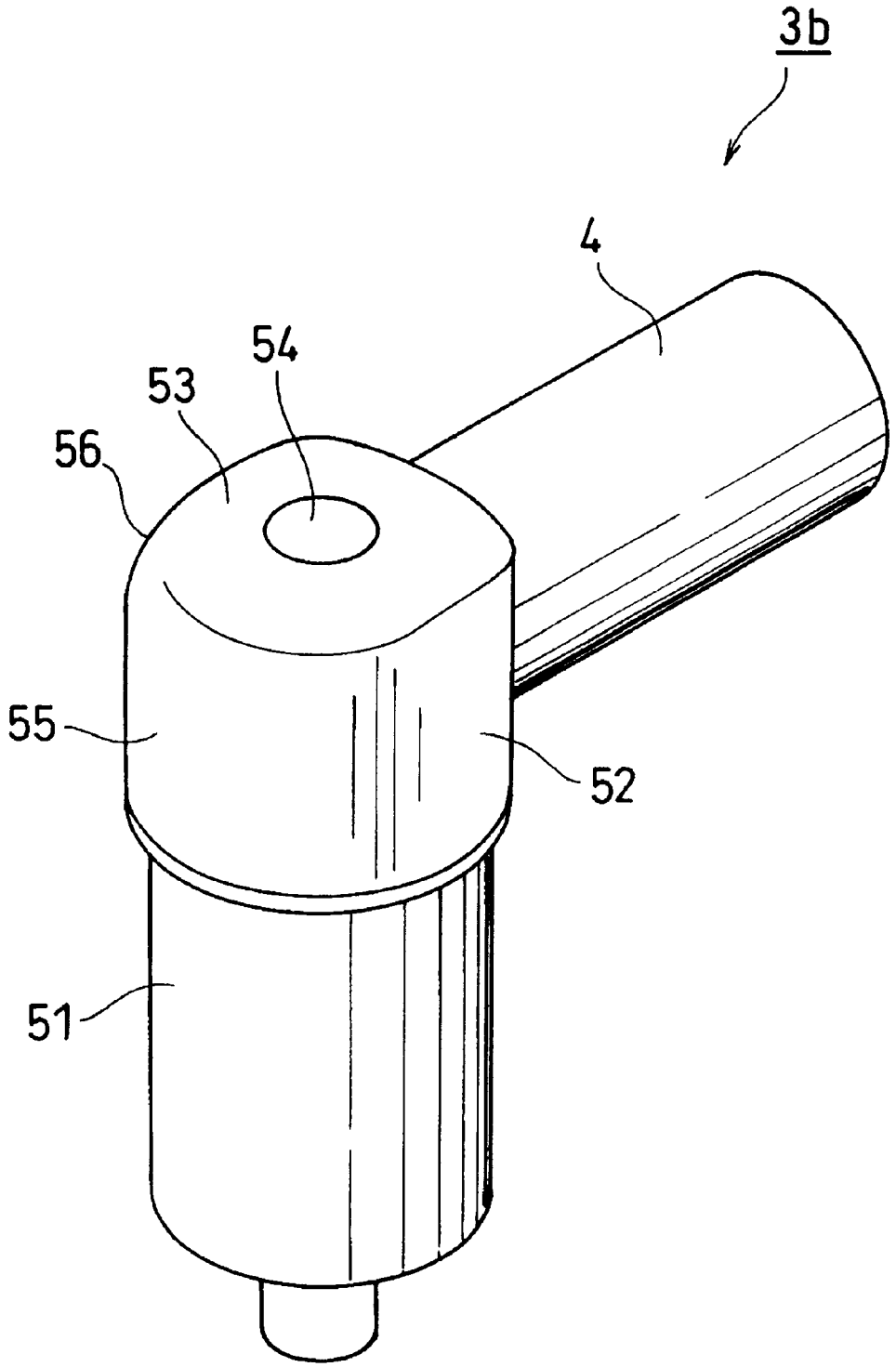
FIG. 9 is an explanatory view of an x-ray tube in accordance with the second embodiment.

FIG. 9 shows an x-ray tube 3*b* in accordance with this embodiment. In the x-ray tube 3*b*, as shown in FIG. 9, ridge portions between the top face 53 and side face 55 of the top part 52 are rounded so as to form a taper surface 56. Here, "taper surface" encompasses not only tilted planes but also outwardly or inwardly curved surfaces.

Figure 10:
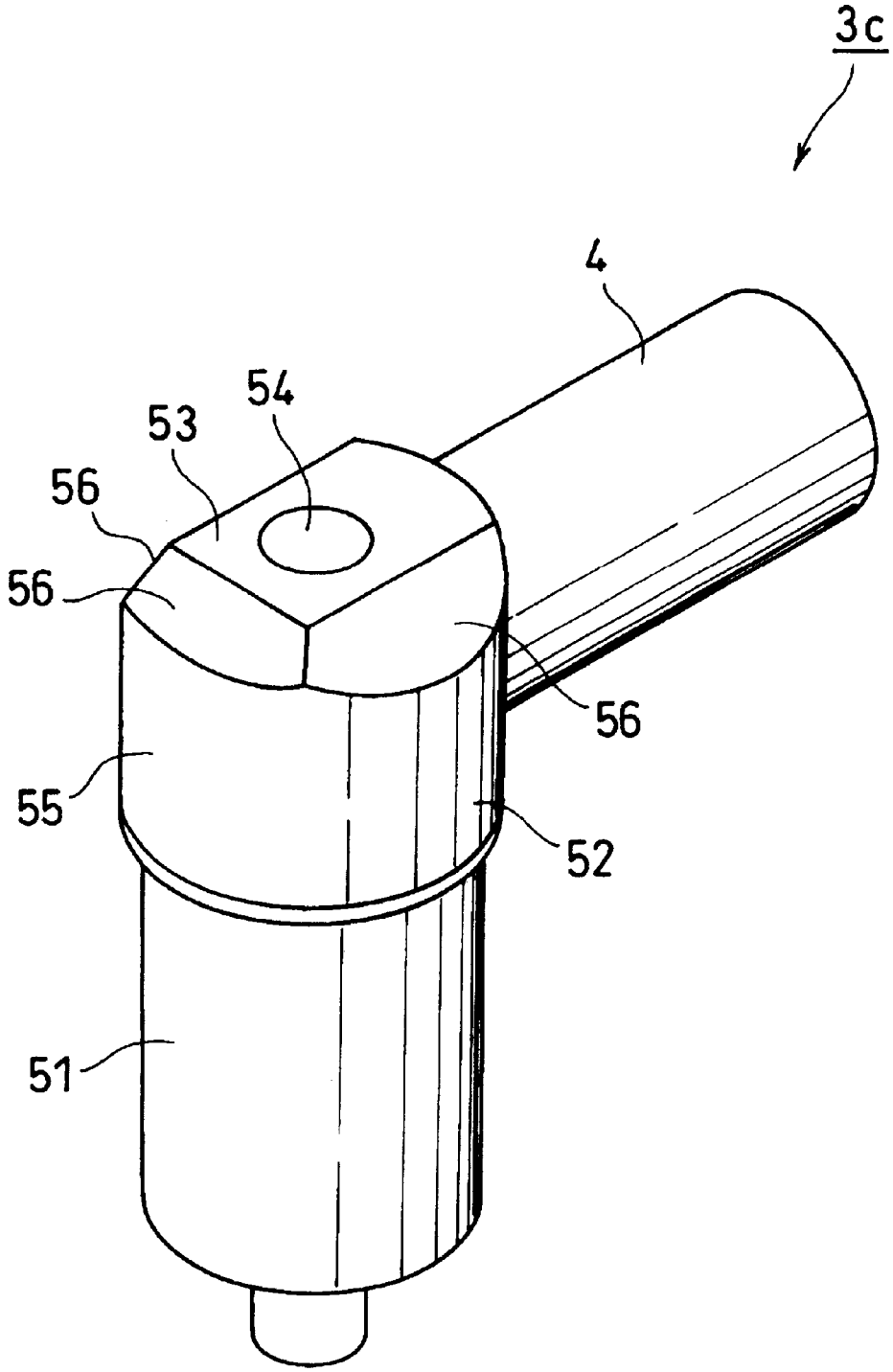
FIG. 10 is an explanatory view of an x-ray tube in accordance with the second embodiment.

FIG. 10 shows an x-ray tube 3*c* in accordance with this embodiment. In the x-ray tube 3*e*, as shown in FIG. 10, tapers 56 are formed at the both side portions and front side of the head part 52.

Figure 11:
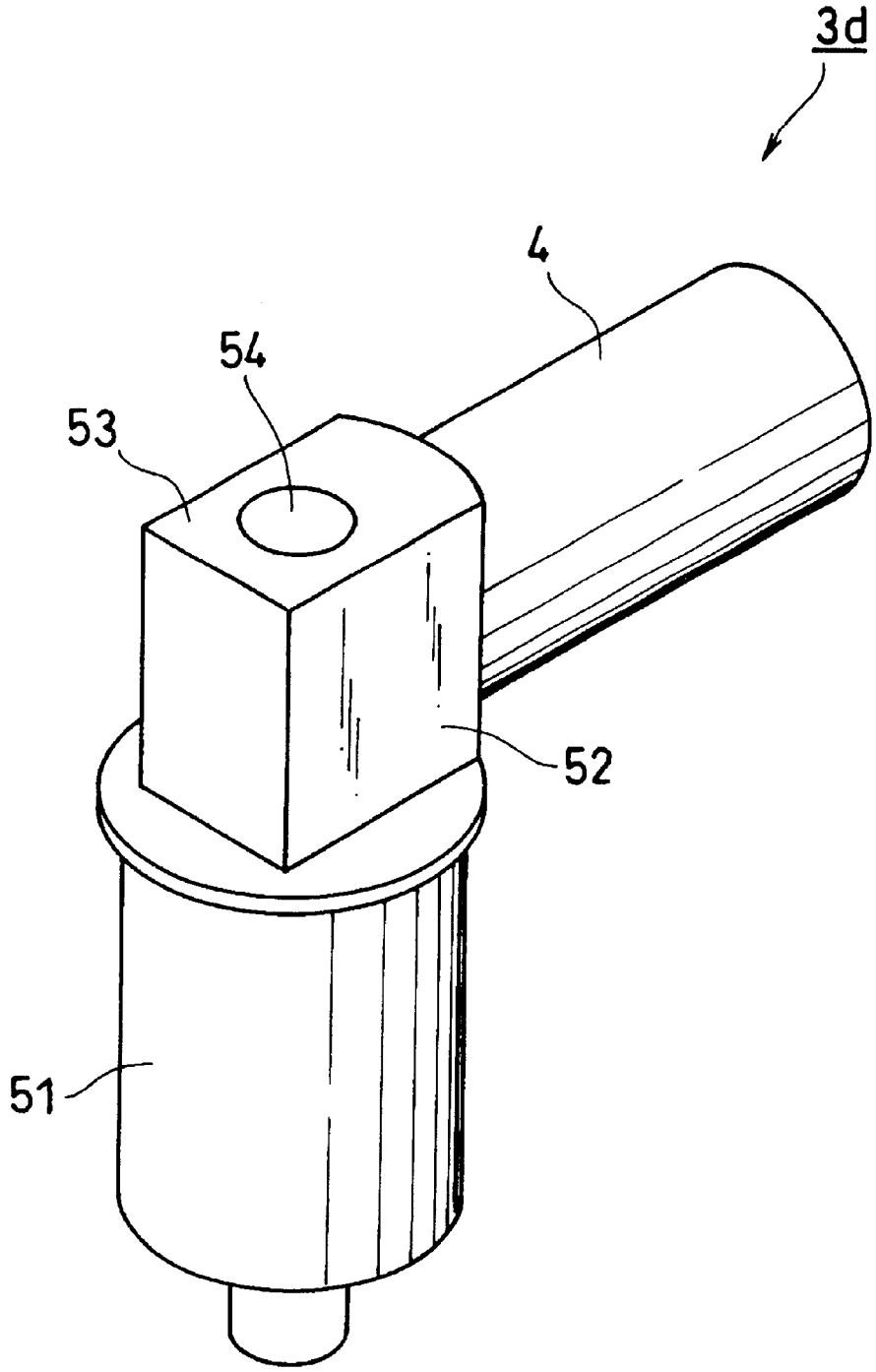
FIG. 11 is an explanatory view of an x-ray tube in accordance with the second embodiment.

FIG. 11 shows an x-ray tube 3*d* in accordance with this embodiment. In the x-ray tube 3*d*, as shown in FIG. 11, both side portions and front face of the head part 52 are vertically shaved off.

When these x-ray tubes 3*a* to 3*d* are used in an inspection system which inspects the internal structure of the sample 93 and the like by irradiating the sample 93 with x-rays and detecting the x-rays transmitted through the sample 93, as in the x-ray tube 3 in accordance with the first embodiment, the taper surfaces 56 or shaved areas formed therein can prevent the sample 93 from coming into contact with the top face 53 even if the sample 93 is pivoted about an axis intersecting the emitting direction while the sample 93 is disposed closer to the x-ray emitting window 54. Therefore, while the sample 93 is disposed closer to the x-ray emitting position, the orientation of the sample 93 can be changed. As a consequence, while a magnified penetration image of the sample 93 with a high magnification rate is obtained, the internal structure of the sample 93 and the like can be verified in detail by changing the orientation of the sample 93.

The x-ray generator in accordance with this embodiment uses any of the above-mentioned x-ray tubes 3*a* to 3*d* in place of the x-ray tube 3 in the x-ray generator 1 in accordance with the first embodiment. When such an x-ray generator is used in an inspection system which inspects the internal structure of the sample 93 and the like by irradiating the sample 93 with x-rays and detecting the x-rays transmitted through the sample 93, as in the x-ray generator in accordance with the first embodiment, the taper surface 23 formed therein can prevent the sample 93 from coming into contact with the top face 21 even if the sample 93 is pivoted about an axis intersecting the emitting direction while the sample 93 is disposed closer to the x-ray emitting window 54. Therefore, while the sample 93 is disposed closer to the x-ray emitting position, the orientation of the sample 93 can be changed. As a consequence, while a magnified penetration image with a high magnification rate is obtained, the internal structure of the sample 93 and the like can be verified in detail by changing the orientation of the sample 93.

Further, operations and effects similar to those of the inspection system in accordance with the first embodiment are also obtained when the x-ray tube or x-ray generator in accordance with this embodiment is used in the inspection system in accordance with the first embodiment.

Third Embodiment

The x-ray tube, x-ray generator, and the like in accordance with a third embodiment will now be explained.

Figure 12:
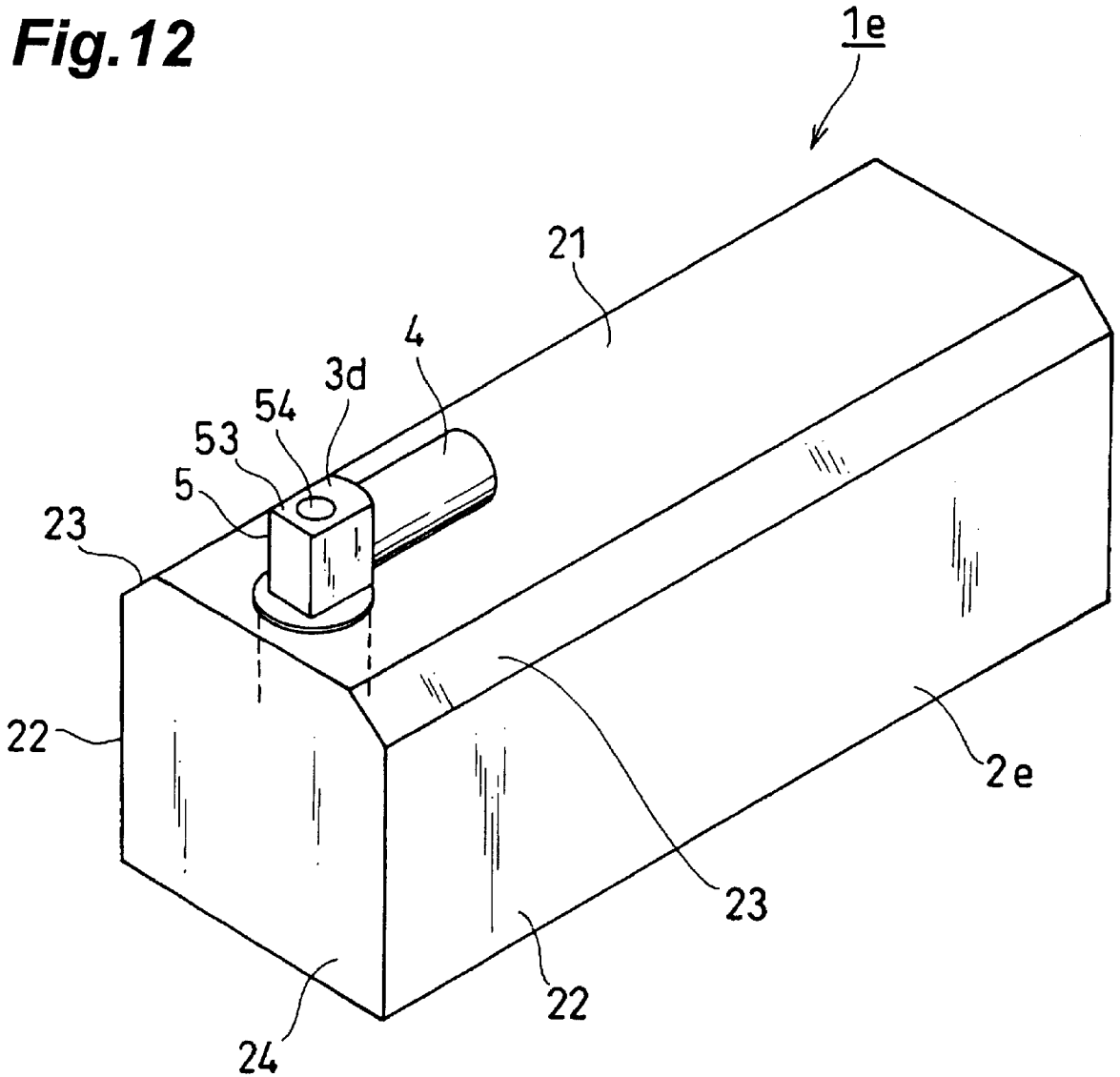
FIG. 12 is an explanatory view of the x-ray generator in accordance with a third embodiment.

FIG. 12 shows the x-ray generator 1*e* in accordance with this embodiment. As shown in FIG. 12, the x-ray generator 1*e* comprises a horizontally elongated housing 2*e*. The top face 21 of the housing 2*e* is provided with an X-ray tube 3*d* which emits x-rays. Both ridge portions between the top face 21 and side faces 22, 22 of the housing 2*e* are chamfered so as to form their respective taper surfaces 23.

When such an x-ray generator 1*e* is used in an inspection system which inspects the internal structure of the sample 93 and the like by irradiating the sample 93 with x-rays and detecting the x-rays transmitted through the sample 93, as with the x-ray generator in accordance with the first embodiment, the taper surfaces 23 formed therein can prevent the sample 93 from coming into contact with the top face 21 even if the sample 93 is pivoted about an axis intersecting the emitting direction while the sample 93 is disposed closer to the x-ray emitting window 54. Therefore, while the sample 93 is disposed closer to the x-ray emitting position, the orientation of the sample 93 can be changed. As a consequence, while a magnified penetration image with a high magnification rate is obtained, the internal structure of the sample 93 and the like can be verified in detail by changing the orientation of the sample 93.

Also, the x-ray generator 1*e* in accordance with this embodiment may use any of the x-ray tubes 3, 3*a* to 3*c* in place of the x-ray tube 3*d*. operations and effects similar to those mentioned above can also be obtained in this case.

Further, operations and effects similar to those in the inspection system in accordance with the first embodiment can also be obtained when the x-ray tube or x-ray generator in accordance with this embodiment is used in the inspection system in accordance with the first embodiment.

As explained in the foregoing, the following effects are obtained in accordance with the present invention.

When the internal structure of an object to be inspected or the like is being inspected by irradiating the object with x-rays and detecting the x-rays transmitted through the object, the forming of a taper surface can prevent the object from abutting against the front end face even if the object is pivoted about an axis intersecting the emitting direction-while the object is disposed closer to the x-ray emitting window. Therefore, while the object is disposed closer to the x-ray emitting position, the orientation of the object can be changed. As a consequence, while a magnified penetration image of the object with a high magnification rate is obtained, the internal structure of the object and the like can be verified in detail by changing the orientation of the object.

What is claimed is:

1. An x-ray generator comprising:

a housing for accommodating components of the x-ray generator, the housing having a taper surface inclined with respect to an emitting direction of said x-ray provided in a surface portion of the housing;

an x-ray tube including an emitting window provided on a front portion thereof from which an x-ray is emitted, the x-ray tube having at least one side portion forming a substantially flat vertical surface, wherein the substantially flat vertical surface includes an edge portion forming at least a portion of a periphery surrounding the emitting window; and an electron gun connected to an outer side portion of the x-ray tube for emitting an electron from an electron emitting surface of the electron gun toward a target surface within the x-ray tube, thereby causing the x-ray tube to generate the x-ray, wherein the electron emitting surface of the electron gun substantially faces toward at least a portion of the target surface within the x-ray tube.

* * * * *